US006079136A

United States Patent [19]

Kozlarek

[11] Patent Number: 6,079,136

[45] Date of Patent: Jun. 27, 2000

[54] LIGHTED MESSAGE SYSTEM FOR USE WITH TRAILER HITCH ARRANGEMENTS

[75] Inventor: Norman A. Kozlarek, Oak Lawn, Ill.

[73] Assignee: Parting Gestures, Inc., Oak Lawn, Ill.

[21] Appl. No.: 09/131,638

[22] Filed: Aug. 10, 1998

[51] Int. Cl.[7] ..... G09F 13/00

[52] U.S. Cl. ..... 40/541; 40/204; 40/556; 40/591; 224/519; 280/507

[58] Field of Search ..... 40/204, 205, 206, 40/541, 556, 591; 280/507; 224/519, 521

[56] References Cited

U.S. PATENT DOCUMENTS

| | | | |
|---|---|---|---|
| 1,224,097 | 4/1917 | Rosenbluth | 40/204 X |
| 1,423,641 | 7/1922 | Bausman | 40/556 X |
| 1,568,222 | 1/1926 | Hemmer | 40/204 |
| 1,715,133 | 5/1929 | Klingla | 40/205 |
| 1,871,648 | 8/1932 | Baker | 40/556 |
| 2,156,806 | 5/1939 | Ducey | 40/205 X |
| 3,271,050 | 9/1966 | Saunders | 280/507 |
| 3,782,761 | 1/1974 | Cardin, Sr. | 280/507 |
| 4,040,641 | 8/1977 | Riecke | 280/507 |
| 4,977,695 | 12/1990 | Armbruster | 40/556 X |
| 5,316,290 | 5/1994 | Parr et al. | 273/1.5 R |
| 5,603,178 | 2/1997 | Morrison | 40/591 |
| 5,800,294 | 9/1998 | Naecker, Jr. | 473/481 |

*Primary Examiner*—Terry Lee Melius
*Assistant Examiner*—Andrea Chop
*Attorney, Agent, or Firm*—Stephen W. White

[57] ABSTRACT

A lighted messaging system that is attachable to a vehicular trailer hitching assembly and can provide suitable protection for the open hitch after the ball is removed. This system utilizes all of the various components of a conventional trailer hitch after the ball joint element is removed therefrom and serves not only to provide an attractive and useful means of communication or advertisement and the like, but also to cover up exposed parts of the trailer hitch after the ball joint element is actually removed. Trailer hitches that use the so-called "draw-tight" system are preferred. Messages in the form of writing or drawings and can encompass any desired communication. Since the messaging system employs a light system, they can be illuminated for better visibility during all light conditions.

8 Claims, 4 Drawing Sheets

9
7
13'
13
12
13'''
13''
12'
11
4
5
10
6
3

LIGHTED MESSAGE SYSTEM FOR USE WITH TRAILER HITCH ARRANGEMENTS

BACKGROUND OF THE INVENTION

1. Field of the Invention

This invention relates to trailer hitch systems for vehicles, trailers and the like and more specifically to covers for this trailer hitch system. Even more specifically, this invention relates to covers that can employ a message display system within said trailer hitch system wherein said message display system can be used for a variety of purposes.

2. Description of the Prior Art

Trailer hitches that can be installed on automobiles, trucks and other vehicular transportation elements are well known in the prior art. These hitches are usually installed somewhere on the rear of the vehicle and usually employ a variety of elements that are also well known. These elements, can be made of a basic device that is securely fashioned to the frame, rear bumper or other area of the vehicle and usually has another element that can be attached to the basic device and which may also contain a ball element to fit into a conventional trailer receptacle, for example. Additionally, an electrical connection is also employed in order to tie in the electrical system usually present on the trailer. Thus, this electrical system can control brake, running and turn-signal lights, for example, as well as other lights, which may be on the sides and back of the trailer. Cars, trucks, RV's and other vehicles commonly are used to pull trailers and other such devices and all of the conventional safety elements are usually present. The wiring system, as well as the hitch-ball system, are normally and conventional, engaged and disengaged when adding a trailer or disconnecting same.

It is also conventional to provide some sort of covering system that can be placed over the hitch after removing the trailer therefrom. This covering system may be simply a device that slides into or attaches to the hitch system and covers the exposed parts when the trailer is disconnected. Rubber covers are conventionally used to cover these parts and prevent weather from further corroding the metallic parts. The ball/hitch can be covered separately but some standard hitch elements have the so-called "draw-hitch" systems wherein there is a basic tow-bar attached to the vehicle and the draw-hitch slides into a slot or opening in this basic tow-bar and attached thereto using a bar and pin passing through the draw-hitch as it is placed within this opening or slot. Thus, the draw-hitch containing the ball is removable when not being used and this is a very desirable state.

There are other cover devices that also employ decorations and the like along with the cover itself. These decorations may include messages for strictly informational or anecdotal reasons and are simply a message or decoration mated to a conventional covering system. Although these prior art elements are useful in nature, they lack certain elements such as an ability to change messages and provide lighting therefor.

Thus, there is a need to provide an attractive and utile cover system for trailer hitch arrangements wherein these attractive and utile cover arrangements have a means for putting in and removing signs therefrom and wherein a lighting arrangement is provided therefor.

SUMMARY OF THE INVENTION

It is an object of this invention to provide an attractive, utile cover system for trailer hitch arrangement wherein said cover also contains a means for placing inside and removing therefrom signs or messages and wherein a lighting arrangement is provided therefor. These and yet other objects are achieved in a protective and utile cover for a vehicle hitch arrangement wherein said hitch arrangement comprises a reinforced member for attaching said hitch arrangement to said vehicle, said attaching member having an opening for accepting a ball joint containing element, and a means for providing electrical power, wherein said protective cover comprises a sliding element fitting said opening having a lighted housing attached thereto, said lighted housing having a messaging element inserted therein, wherein when said lighted housing is attached to said electrical power, said messaging element will be illuminated.

DETAILS OF THE INVENTION

Figure 1:
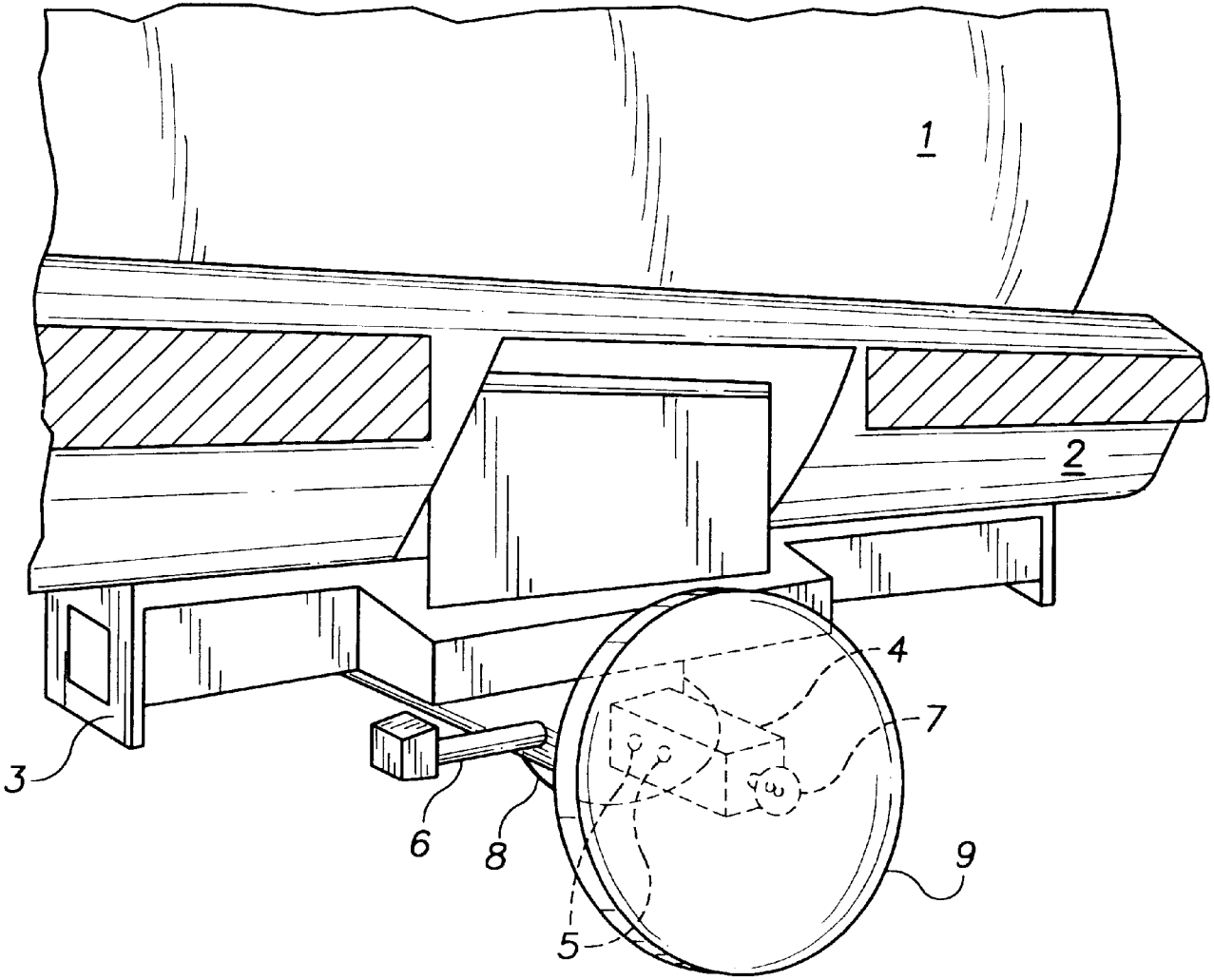
FIG. 1 is a drawing showing the rear portion of a vehicle with a hitch arrangement and the message display and cover system installed therein.

Looking now specifically at the drawings, which represent, but do not fully cover, all the various embodiments envisioned within this invention, FIG. 1 is a close-up view of just the hitch arrangement and the message display and cover system installed therein as it attached to the rear portion of a vehicle, for example. In this figure, 1 is the rear portion of a vehicle and 2 the rear bumper thereof. A reinforcing member 3 of the hitch arrangement package is shown attached to the frame of the vehicle (not shown) underneath the rear bumper 2. Within this reinforcing member 3, a conventional hitch arrangement will consist of an opening into which will accept a ball joint containing element that is not shown in this figure since that portion of the hitch arrangement is now occupied by the lighted messaging system of this invention. This system comprises an insert member 4 which is slidably connected to the reinforcing member 3 fitted into an opening therein. Several holes shown as 5 are provided along the length of this insert member and these holes can be matched up with holes along the length of the opening within the reinforcing member 3. A pin 6, which is used to afix the ball joint arrangement firmly in place, is used here to hold insert member 4 within the same opening. At the front end of this insert member 4, a bulb 7 is shown connected (connection point not shown) to a wiring harness 8. Placed over this bulb element 7 is a message containing element 9. A message (not shown in this figure) can be inserted within the message containing element 9 and lighted up to demonstrate or advertise to other vehicles. In addition, this entire system serves to fill the opening within the hitch arrangement and thus cover and protect this opening.

Figure 2:
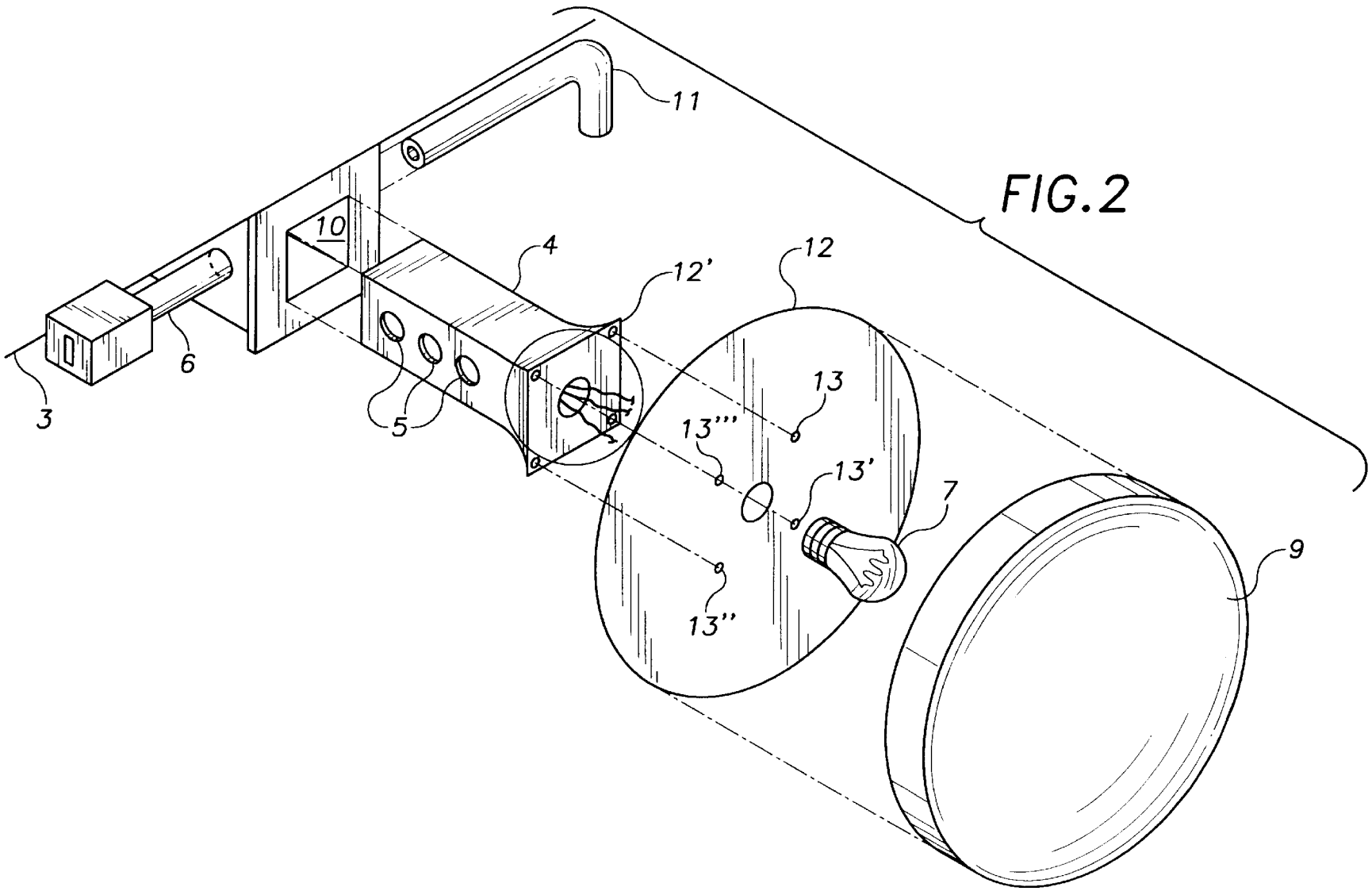
FIG. 2 is a close-up view of just the hitch arrangement and the message display and cover system installed therein. The parts of this system are shown pulled away from the system itself.

FIG. 2 is a more detailed showing of the messaging system of this invention. In this figure, 4 is the insert member that slides into the opening 10 of the hitch arrangement 3 (only the bottom of the hitch arrangement 3 is shown in this figure). Holes 5 are placed along the length of the insert member 4 and these, then, can be matched up with a hole along the opening 10 if the hitch arrangement 3. A pin 6 is then placed into and through the selected hole to firmly attach the insert member within the opening 10. An attaching means, which insures that pin 6 will not be dislodged during movement of the vehicle, is shown as 11. A bulb 7 is shown somewhat apart from a housing mount 12. This housing mount 12 is attached to the front end 12' of the slidable insert member 4 by a set of connecting means shown as 13, 13', 13" and 13'". This means can be nuts and bolts, for example. The message containing element 9 is then shown. This message containing element 9 may then be attached so as to cover bulb 7 and housing mount 12.

Figure 3:
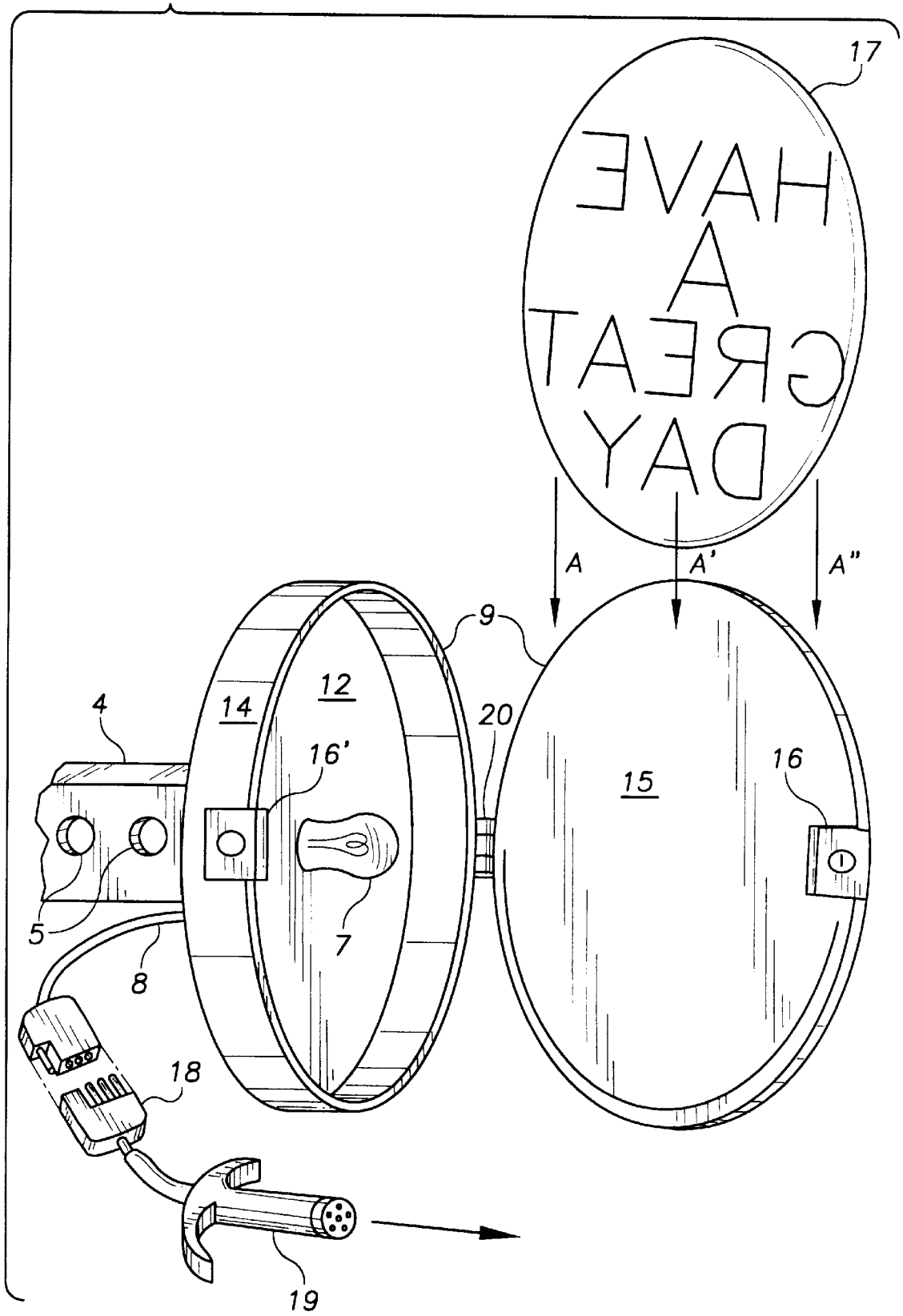
FIG. 3 is a detailed showing of just the message display and cover system of this invention with a written message inserted therein.

FIG. 3 is a close up view of the entire lighted messaging center of this invention. In this FIG. 4 is again the slidable insert member and 5 two holes that are used when the insert member 5 is inserted into opening of a hitch arrangement. The housing mount 12 is shown attached to the front end (not shown in this figure) of the insert member 4. A bulb 7 has been attached to the housing mount 12 and the message containing element 9, which is comprised of two parts (a housing member 14 and a front lens member 15) is attached to the housing mount 11. A locking arrangement 16 and 16' insure that the two parts of the message containing element 8 can be closed securely. A message 17 is shown removed from this message containing element 9. This message (which is shown here as "HAVE A GREAT DAY") can be placed within the message containing element 9 just behind the front lens member 15 so that when the bulb 7 is electrified the message will be suitably illuminated. The message should be inserted following arrows A, A' and A". Electrification can be supplied through wiring harness 8. This wiring harness 8 is attached through a connection point 18 and from there to a power cord 19 which is representative of a typical wiring connection to a vehicle, for example. A hinge 20 is shown connecting the two parts 14 and 15 of the message containing element 9.

Figure 4:
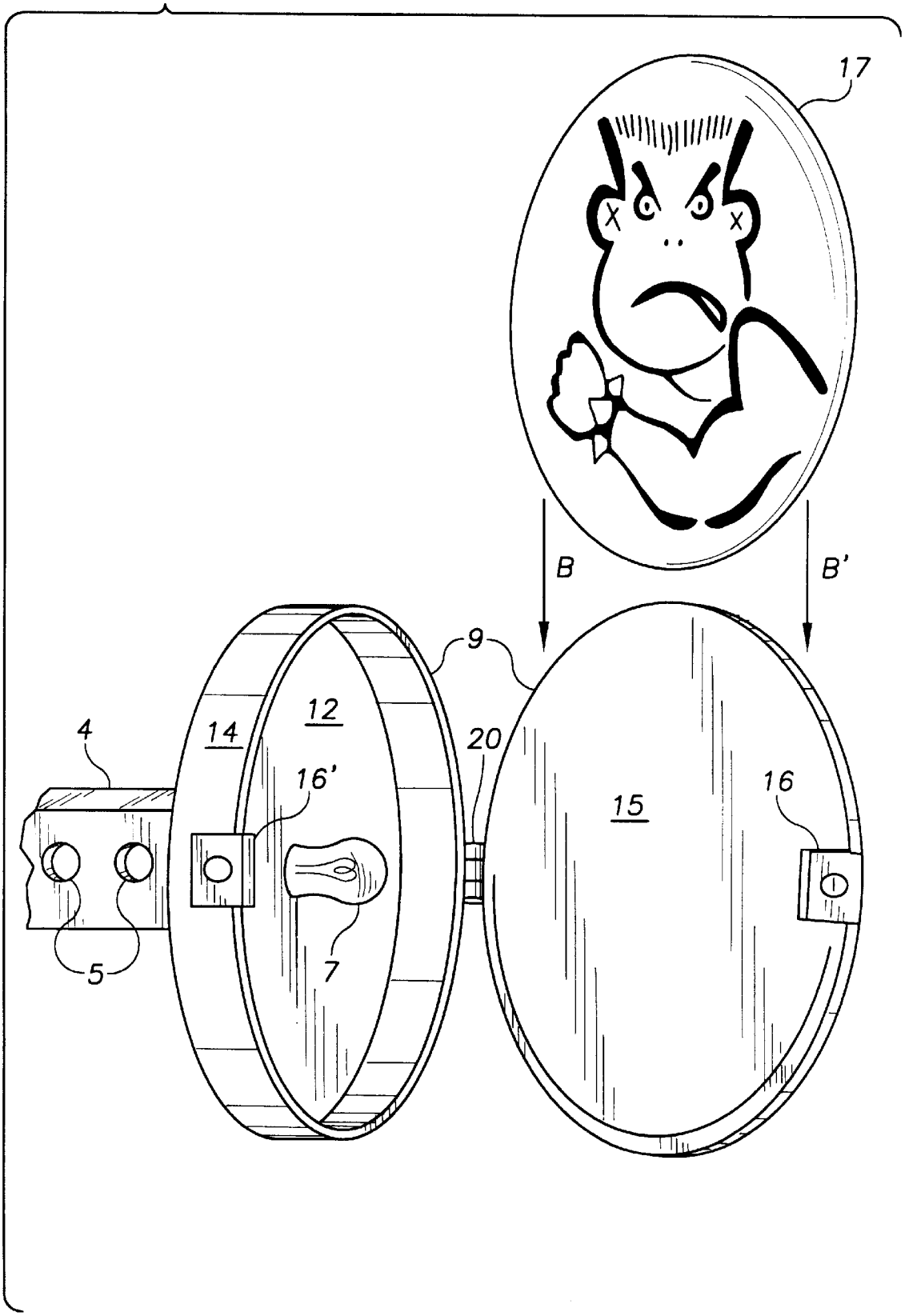
FIG. 4 is similar to FIG. 3 but a drawing has been substituted for the written message.

FIG. 4 is very similar to that of FIG. 5 except that the message 18 is shown as a drawing. The drawing is inserted into the message containing element 9 along arrows B and B'. Other elements of the device of this invention are numbered as shown previously or are not, for convenience, shown therein.

As mentioned, there are a host of messages and drawings that can be included within the message containing element 9 of this unit. These messages and drawings or signs can be uplifting or informative or can be jocular or entertaining in nature. A message and a drawing are shown in the figures and these can be modified in any manner imagined. They can be used by fraternities or sports teams and the like so as to link one member to the others. By having a lens arrangement, the message can be well seen by any passer by or by other vehicles. Since I provide for a lighting system within the unit of this invention it can be seen at any time of day or night and makes use of the conventional lighting connections that are already present within the trailer hitch element itself. The size of the device of this invention will be controlled by the size of the trailer hitch element with which it is designed to be used. The message containing element can easily be made of a plastic material such as polystyrenes, polyvinyl chloride or acetates, vinyl materials and the like. The size of this part of the element can be designed to hold the sign or message desired. I have shown an oval or circular message containing element but one that is square or oblong is also functional within the ambit of this invention. I think that an element around 5" to 12" in diameter is preferred with 7" mostly preferred. The message containing element 9 should be comprised of a housing 14 and a lens element 15 and these two parts can be connected by either a hinging or other means, including a snap-together means, for example. If the message containing element is designed to be locked, then a hinge is preferred and this hinge can take on the shape of any conventional hinges. The hinge can also be spring loaded so as to facilitate the closing of the lens to the housing.

The device of this invention can be made of any conventional materials including metals, plastics and the light, or combination of two or more materials. It would be conventional to make the device of this invention out of a combination of iron or steel metals and plastic for the housing and the like.

A locking system may be employed within the ambit of this invention to insure that the device is safe from theft. This locking element may also be keyed to further insure safety.

The message or drawing should be manufactured of a translucent or transparent material so as to facilitate the passage of light thereby. There are a host of materials that can be used such as thin glass, translucent paper or cardboard and the like. These messages or drawings can be affixed within the message containing element with any materials well-known to the prior art such as small, tacky adhesive points, grooves or other elements made part of the lens or housing portions thereof. However, the materials of manufacture and details or construction are not particularly pertinent to the essence of my invention but are easily discernable by anyone of normal skill in the art.

The device of this invention is not only utile for messaging and sending information but will also block the opening left within the trailer hitch when the ball joint is removed and the trailer hitch is not in use for pulling trailers and the like. By blocking this opening, dirt and rust are prevented and the trailer hitch will be kept suitable for further use. The device of this invention is so similar to the conventional trailer hitch assembly that it is easy for the user to add and remove. All connection points and electrical connections can be made identical to those used within the trailer hitch itself. Although the device of this invention can be used with any conventional vehicle, the preferred vehicle of use is a Sport Utility Vehicle or a pick-up truck.

I claim:

1. A protective cover element for a vehicle hitch assembly, said vehicle hitch assembly comprising a means for attachment to the rear end of said vehicle, an adjustable draw-hitch element for receiving a ball hitch, said protective cover element comprising:

a. a rectangular member having a length and two ends, one of said ends being insertable within said adjustable draw-hitch receiving element and attachable thereto, said insert member having a longitudinal axis and at least two openings along said length perpendicular to said longitudinal axis;

b. a pin insertable through one of said openings for attaching said insert member to said adjustable draw-hitch receiving element;

c. a message receptacle element directly attached to the other end of said insert member, said message receptacle element comprising a housing member and a transparent lens member;

d. a message inserted within said message receptacle housing; and, e. a lighting means for illuminating said message, so that when said ball hitch is removed from said adjustable draw-hitch element, said insert member can be placed therein to provide a protective cover therefor and to provide an illuminated messaging element at the rear of said vehicle.

2. The protective cover element of claim 1 wherein said message is a written message.

3. The protective cover element of claim 1 wherein said message is in the form of a drawing.

4. The protective cover element of claim 1 wherein said lighting means includes 12 volt electrical power.

5. The protective cover element of claim 1 wherein said lens member is hingeably connected to said housing member.

6. The protective cover element of claim 5 wherein said lens member and said housing member are locked together.

7. The protective cover element of claim 1 wherein said protective cover element is adapted for use on a sports utility vehicle.

8. The protective cover element of claim 1 wherein said protective cover element is adapted for use on a pick-up truck.

* * * * *